United States Patent [19]

Lamberti

[11] 3,990,983

[45] Nov. 9, 1976

[54] BUILDER COMPOSITIONS

[75] Inventor: Vincent Lamberti, Upper Saddle River, N.J.

[73] Assignee: Lever Brothers Company, New York, N.Y.

[22] Filed: Dec. 3, 1973

[21] Appl. No.: 420,804

[52] U.S. Cl. ..... 252/99; 252/95; 252/102; 252/DIG. 11; 252/89 R; 252/106; 252/187 H; 252/528

[51] Int. Cl.[2] ..... C11D 7/54

[58] Field of Search ..... 252/99, 95, 102, 528, 252/DIg. 11, 180, 181, 187 H, 187 C, 106

[56] References Cited

UNITED STATES PATENTS

| | | | |
|---|---|---|---|
| 3,692,685 | 9/1972 | Lamberti et al. | 252/89 |
| 3,703,470 | 11/1972 | Brennan | 252/99 |
| 3,769,223 | 10/1973 | Pearson et al. | 252/89 |
| 3,850,832 | 11/1974 | Wegemund et al. | 252/99 |

*Primary Examiner*—Mayer Weinblatt
*Attorney, Agent, or Firm*—Arnold Grant

[57] ABSTRACT

A mixture of an alkali metal or alkaline earth carboxymethyloxysuccinate and a chlorine-releasing agent or an appropriately activated oxygen-releasing agent provides a builder combination suitable for use in detergent compositions to improve the detergency over that obtained when the carboxymethyloxysuccinate is the sole builder. The compositions are also useful in acidic solutions and have utility for the cleaning of metal and other hard surfaces.

1 Claim, No Drawings

BUILDER COMPOSITIONS

BACKGROUND OF THE INVENTION

1. Field of the Invention

Trisodium carboxymethyloxysuccinate has recently been disclosed as a builder salt to enhance the cleaning power of detergent surfactants, and to replace detergent builder phosphates in cleaning compositions, as set forth in U.S. Pat. No. 3,692,685, assigned to the instant assignee, and incorporated herein by reference.

As explained in the aforesaid patent, the carboxymethyloxysuccinates are biodegradable and non-eutrophying and are excellent substitutes for the established detergent builder polyphosphates which are suspected of being a factor in the eutrophication of lakes, etc. However, the level of fabric detergency to which the consumer has become accustomed from the use of polyphosphate-built detergents is not quite reached in the overall use of trisodium carboxymethyloxy-succinate as a replacement for polyphosphates. Typical of the comparative efficacy are the results shown in a series of experiments designated as Examples 1–10 in the aforesaid U.S. Pat. No. 3,692,685. In this series the detergent effect of the trisodium carboxymethyloxysuccinate-built detergent compositions is shown to vary from 82 to 97% of the detergency of a comparative sodium tripolyphosphate-built detergent composition. The data also indicate that the detergency-enhancing effect of trisodium carboxymethyloxysuccinate is greater on some detergent species than on others.

Sodium citrate has also been suggested as a builder substitute for polyphosphates in detergent compositions. However, sodium citrate possesses the disadvantage that it reacts with sodium hypochlorite at pH levels below about 8.5 where significant amounts of the hypochlorous acid species are present. This disadvantage becomes evident in home laundering since in many instances wherein the soil on the fabric being washed is acidic, the pH of the wash solution drops below 8.5, causing the citrate to become reactive towards any hypochlorite bleach that may be added and thereby, impairing the bleaching efficiency and detergency of the washing operation.

Carboxymethyloxysuccinic acid and its salts, on the other hand, are stable towards hypochlorite in both acidic and alkaline solution and, for this reason, the compositions of the present invention are useful for cleaning fabrics and, particularly in acidic media, for the cleaning and sanitizing of metal surfaces and other hard surfaces such as walls and floors.

2. Discussion of the Prior Art

Trisodium carboxymethyloxysuccinate, a method for its preparation, and its properties as a detergent builder are extensively discussed in U.S. Pat. No. 3,692,685. Example 11 of this patent discloses a dishwashing composition containing 43.0% trisodium carboxymethyloxysuccinate with 21.0% chlorinated trisodium phosphate.

Chlorinated compounds of the type referred to in the instant specification as chlorine-releasing agents, which liberate elemental chlorine under the conditions of use set forth herein, are well known in the detergent, bleaching and sanitizing arts. Disclosures of typical chlorine-releasing agents, preparative procedures, and uses in combination with certain detergents and additives may be found collectively in the following list of patents, which is by no means exhaustive.

| | |
|---|---|
| U.S. Pat. Nos. | 1,555,474;<br>1,950,956;<br>1,965,304;<br>2,929,816;<br>3,035,054;<br>3,035,056;<br>3,035,057;<br>3,110,677;<br>3,112,274;<br>3,346,502. |

Chlorine-releasing agents are disclosed in the ACS Monograph entitled "Chlorine — Its Manufacture, Properties and Uses" by Sconce, published by Reinhold in 1962.

Oxygen-releasing compounds are disclosed in the following patents.

| | |
|---|---|
| U.S. Pat. Nos. | 2,706,178;<br>2,955,086;<br>3,075,921;<br>3,131,995. |

Activators for peroxy compounds are disclosed in the following patents.

| | |
|---|---|
| U.S. Pat. Nos. | 2,955,905<br>3,177,148<br>3,211,658<br>3,245,913<br>3,398,096 |
| German Pat. No. | 1,018,181 |
| French Pat. No. | 1,199,123 |
| Great Britain Pat. No. | 984,459 |
| Great Britain Pat. No. | 1,025,791 |

U.S. Pat. No. 3,306,858 discloses a method for incorporating a nonionic detergent and a chlorine-releasing agent together in the same detergent compositions. The method comprises absorbing the nonionic detergent on a particulate carrier, for example a polyphosphate, followed by coating with a sodium silicate solution. The coated particles are dried or further mixed with an inorganic salt to absorb excess moisture. Following the foregoing encapsulation procedure, the encapsulated particles are mixed with particles of a chlorine-releasing agent.

U.S. Pat. No. 3,717,580 discloses that excess hypochlorite remaining after a sanitizing procedure can be destroyed by contact with citric acid, a compound isomeric with carboxymethyloxysuccinic acid. While this is an advantage when hypochlorite is used on hard surfaces, it is a disadvantage when citrate is used as the detergent builder in the washing of fabrics and hypochlorite bleach is added to the wash, particularly since citric acid and hypochlorites are more reactive in solution if the pH is below about 8.

SUMMARY OF THE INVENTION

It has now been discovered that the fabric detergency of a trisodium carboxymethyloxysuccinate-built detergent composition can be made to equal or exceed that of a corresponding tripolyphosphate-built detergent composition by the inclusion therewith of a chlorine-releasing agent or an appropriately activated oxygen-releasing agent.

It has also been discovered that, contrary to the property of sodium citrate, a detergent builder isomeric with trisodium carboxymethyloxysuccinate, of reacting with sodium hypochlorite, particularly at pH 7, trisodium carboxymethyloxysuccinate is unreactive under the same conditions.

It is accordingly an object of the present invention to improve the detergency of a trisodium carboxymethyloxysuccinate-built detergent composition.

It is another object of the invention to provide a built detergent composition wherein the builder is non-eutrophying to overcome the disadvantage of polyphosphates, and is unreactive toward hypochlorites, to overcome the disadvantage of citrate builders.

It is a further object of the invention to provide a composition suitable for cleaning metal surfaces, such as food processing equipment, and other hard surfaces such as walls and floors, in acidic media.

The aforementioned improvement in detergency is accomplished by the inclusion of a chlorine-releasing agent or an oxygen-releasing agent with the carboxymethyloxysuccinate-built detergent composition as more fully described hereinbelow.

DETAILED DESCRIPTION OF THE INVENTION

As a first embodiment, the invention broadly contemplates a builder combination suitable for use in detergent compositions comprising a mixture of an alkali metal chlorine-releasing or oxygen-releasing compound and a polycarboxy salt having the general formula

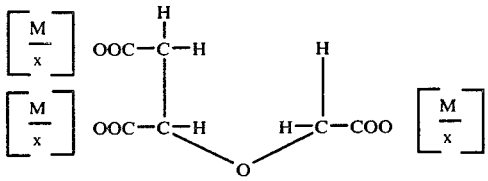

Wherein M is hydrogen or an alkali metal, calcium or magnesium water-solubilizing cation, or mixtures thereof, and $x$ is an integer having a value equal to the valence of M. A useful calcium salt has the formula

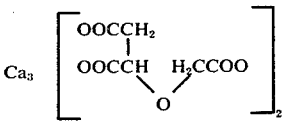

The term "alkali metal" includes sodium, potassium and lithium. The two first-named alkali-metal cations are preferred. In instances wherein stains or soils containing heavy metal compounds such as iron compounds are to be removed as part of the cleaning operation, the alkaline earth metal salts of carboxymethyloxysuccinic acid may advantageously be employed since these are prepared as precursors in the manufacture of the alkali metal salts of carboxymethyloxysuccinic acid and, moreover, readily exchange their alkaline earth metal cations for the heavy metal cations.

In a second embodiment, the invention provides a particulate or liquid detergent composition comprising a quaternary ammonium detergent or a substantially nitrogen-free anionic detergent, trisodium carboxymethyloxysuccinate, and a compound to release chlorine or oxygen as hereinafter defined.

In a third embodiment the invention contemplates solutions containing the aforementioned combination at concentrations normally used for washing fabrics in automatic machines. Usually such solutions will contain i. about 200 ppm to about 2000 ppm of an anionic or a quaternary ammonium nonsoap surfactant having detergent properties, or mixtures thereof, ii. about 50 ppm to about 300 ppm of a chlorine-releasing agent, iii. about 200 ppm to about 2000 ppm of a polycarboxy salt having the general formula

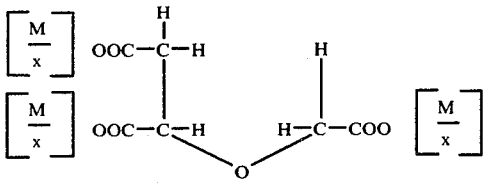

wherein M is hydrogen or an alkali metal, calcium or magnesium cation, and x is the valence of M, and iv. water as essentially the balance of the formulation.

The structural formula set forth hereinabove includes a conventional representation of the cation portion of the molecule, although it will be understood that when the cation is calcium or magnesium, having a valence of 2, each calcium or magnesium cation may be associated with any two carboxyl groups on the same anion or with two carboxyl groups on different anions.

The compositions of the invention are useful under both acidic and alkaline conditions, specifically within the pH range of about 3 to about 12.

By the term "chlorine-releasing agent" as used herein is meant any inorganic or organic compound having chlorine in its molecule and which is capable of having its chlorine liberated as elemental chlorine to form hypochlorous acid or its salts under the conditions usually employed for detergent, bleaching or sanitizing purposes.

A non-limiting list of chlorine-releasing agents suitable for use in the present invention includes:

hypochlorous acid,
sodium hypochlorite,
lithium hypochlorite,
calcium hypochlorite,
chlorinated trisodium phosphate,
monochloramine
dichloramine,
sodium dichloroisocyanurate,
potassium dichloroisocyanurate,
dichlorocyanuric acid,
trichloroisocyanuric acid,
[(monotrichloro)-tetra(monopotassium dichloro)]-pentaisocyanurate,
1,3-dichloro-5,5-dimethylhydantoin,
N,N'-dichlorobenzoyleneurea, para-toluene sulfondichloramide,
N,N-dichloroazodicarbonamide,
trichloromelamine,
N-chloroammeline,
N-chlorosuccinimide,
N-chloroacetylurea,
N,N'-dichlorobiuret,
chlorinated dicyandiamide,
sodium salt of N-chloro-p-toluenesulfonamide.

By the term "oxygen-releasing agent" as used herein is meant any inorganic or organic peroxy compound capable of having its oxygen released as elemental oxygen or as hydrogen peroxide or its salts under the conditions usually employed for washing, bleaching or sanitizing. The oxygen-releasing agents may require an activator or promoter to aid in the release of oxygen, particularly when employed at the temperatures not substantially higher than those typically encountered in automatic washing machines, e.g., about 120° to about 140° F.

A non-limiting list of oxygen-releasing compounds suitable for use in the present invention includes:

sodium perborate,
sodium percarbonate (sodium carbonate peroxide)-$2Na_2CO_3.3H_2O_2$,
sodium perborosilicate,
sodium dipersulfate,
diperisophthalic acid and salts thereof,
peroxybenzoic acid, and the 2-chloro, 3-chloro, 4-chloro, 3-methyl, 4-methyl, 2-nitro, 3-nitro, 4-nitro, 4-methoxy, 4-isopropyl, 4-tert-butyl, 4-cyano, and the 2,4-dichloro derivatives thereof, as disclosed in U.S. Pat. No. 3,075,921.

Activators for enhancing the bleaching action of water-soluble inorganic percompounds may be one wherein a transition element in the periodic system is added to a powdered carrier selected from the groups consisting of water-insoluble or hardly soluble compounds of Zn, Cd, Ca, Mg, Al, Sn, Be, Ti, Sb, Bi and $SiO_2$.

The foregoing activators are disclosed in U.S. Pat. No. 3,398,096.

Other suitable activators are diacylorganoamides disclosed in U.S. Pat. No. 3,177,148, including N-acetyl anthranil,
N,N-diacetyl-5,5-dimethylhydantoin
N,N-diacetylaniline
N,N-diacetyl-p-toluidine
N,N-diacetyl-p-chloroaniline
N,N-dibutyrylaniline
Dibenzanilide
N-acetyl caprolactam
N,N'-diacetylbarbitone
N-acetyl phthalimide
N-acetyl saccharin The method for preparing trisodium carboxymethyloxysuccinate is described in the aforementioned U.S. Pat. No. 3,692,685. The salt may be prepared by reacting together maleic acid, glycolic acid and calcium hydroxide, or other divalent metal hydroxide, in water at reflux temperatures, cooling, adding sodium carbonate, and filtering to remove the resulting divalent metal carbonate.

Carboxymethyloxysuccinic acid and its salts are stable toward chlorine-releasing and oxygen-releasing agents.

The detergent suitable for use with the builder combination of the invention is any detergent species that is compatible with the chlorine- or oxygen-releasing agent.

Among the detergent species adversely affected by the chlorine-releasing agents are the anionic detergents having nitrogen or substantial unsaturation in the molecule, and most nonionics.

However, nonionic detergents that have a low weight-percentage of hydroxyl groups in the molecule and additionally are nitrogen-free are stable toward chlorine-releasing agents, and may be employed in the compositions of the present invention, being especially useful when the composition is in particulate form. Stable nonionics within the above description are the Pluronics (trade mark of the Wyandotte Chemicals Corporation) formed by condensing propylene oxide with propylene glycol to a molecular weight of about 600–2500 to form a base, followed by condensing ethylene oxide to this base to the extent of about 20% to about 90% by weight, total molecule basis. Suitable non-ionic species of this type are disclosed in U.S. Pat. Nos. 2,674,619 and 2,677,700. Other useful nonionics are disclosed in U.S. Pat. No. 3,048,548.

The lower molecular weight nonionic detergent species may be used if the compositions are freshly prepared before use. Nonionics falling within this category are the ethoxylated alkyl phenols having 6–12 carbon atoms in the alkyl portion, which may be straight or branched, and having 6–25 molar proportions of ethylene oxide, and ethoxylates of alkanols having 8–18 carbon atoms per molecule and 5–30 molar proportions of ethylene oxide wherein the ethylene oxide content is at least about 52% by weight.

Specific nonionic species falling within the above classes are: branched-chain nonyl phenol condensed with 8–14 molar proportions of ethylene oxide, a mixed $C_{11}$–$C_{15}$ secondary alcohol condensed with 9–14 molar proportions of ethylene oxide, a mixed $C_{14}$–$C_{15}$ alcohol made by the Oxo process condensed with 9–12 molar proportions of ethylene oxide, a mixture of 65% $C_{14}$ and 35% $C_{15}$ synthetic straight chain primary alcohols condensed with 9–15 molar proportions of ethylene oxide, or the mixed fatty alcohols (predominantly of 12 and 14 carbon chain length) derived from coconut oil condensed with about 10 to about 30 molar proportions of ethylene oxide.

Among the suitable anionics there may be mentioned the alkylarylsulfonates, more specifically the alkylbenzenesulfonates wherein the alkyl group is a straight chain having about 11 to about 15 carbon atoms or mixtures thereof, and the sulfonated phenyl group is randomly positioned along the alkyl chain. The alkylbenzenesulfonates may have a branched alkyl group of about 9 to about 15 carbon atoms, or mixtures thereof, such as may be derived from polypropylene and described in U.S. Pat. Nos. 2,477,382 and 2,477,383. Also useful are the alkylbenzenesulfonates described in U.S. Pat. Nos. 2,390,295, 3,320,174 and in Nos. 2,712,530 and 2,723,240.

The alkyl sulfate salts are useful in the practice of the invention, particularly the sodium alkyl sulfates wherein the alkyl group is straight or branched, substantially saturated, and has about 12 to about 18 carbon atoms, but may have as low as 6 carbon atoms in admixture with longer chain lengths, for example when the alkyl group is a mixture derived from coconut oil, palm kernel oil, or other tropical nut oil.

Useful detergents include the alkanesulfonates having about 8 to about 18 carbon atoms, preferably about 10 to about 14 carbon atoms. The alkanesulfonates may be prepared by methods known in the art, for example as described in U.S. Pat. No. 3,541,140.

The disodium salts of alpha-sulfonated fatty acids may be employed, or a methyl or ethyl ester thereof as disclosed in U.S. Pat. No. 3,338,838.

The alkali-metal acyl isethionates having about 12 to about 18 carbon atoms in the acyl groups may be used. Suitable preparatory procedures for the acyl isethionates may be found in U.S. Pat. Nos. 3,320,292, 3,376,229, 3,151,136, 3,383,396, 3,420,857 and 3,420,858.

A suitable anionic mixture comprises about equal parts by weight of i. a sodium salt of a sulfated condensate of an aliphatic monohydric alkanol having about 12–14 carbon atoms and an average of about 3 molar proportions of ethylene oxide, and ii. sodium alkylbenzenesulfonate wherein the benzene ring is randomly positioned along a linear alkyl group having an average of about 13 carbon atoms.

If desired the detergent component may be a quaternary ammonium compound, for example cetyltrimethylammonium bromide
dodecyldimethylbenzylammonium chloride
tetradecyldimethylethylbenzylammonium chloride
carboxymethyldimethyltetradecylammonium choride
carboxymethyldimethyloctadecylammonium chloride
1,1′-oxybis[N-tetramethylene-N-carboxymethylpiperidinium chloride]
1,1′ethylenebis[N-oxyethylene-N-carboxymethylpiperidinium chloride]
benzyl dibutyl-2-[2,3,4,6-tetrachlorophenoxy)ethoxy]-ethyl ammonium chloride
diisobutylphenoxyethoxyethyldimethylbenzylammonium chloride
diisobutylcresoxyethoxyethyldimethylbenzylammonium chloride
N-methyl-N-(2-hydroxyethyl)-N-(2-hydroxydodecyl)-N-benzyl ammonium chloride
Stearyl trimethylammonium bromide
Lauryldimethylchlorethoxyethylammonium chloride
Alkyl ($C_8$–$C_{18}$)dimethyl(3,4-dichlorobenzyl)ammonium chloride
Lauryl pyridinium bromide
Lauryl isoquinolinium bromide
N(Lauroyloxyethylaminoformylmethyl)pyridinium chloride
Betaines, such as beta(hexadecyldiethylammonio)-propionate, and
Sultaines, such as 3-(tetradecyldimethylammonio)ethane-1-sulfonate.

Other detergent adjuncts having detergent-building properties may be present in the compositions of the invention in minor amounts relative to the aforesaid carboxymethyloxysuccinate. For example, there may be present sodium carbonate, sodium silicate, condensed phosphates, orthophosphates, borates, tetrasodium oxydisuccinate, starch- or cellulose-derived polycarboxylates, polyacrylates, soil-suspending agents, hydrotropes, corrosion inhibitors, dyes, perfumes, optical brighteners, fillers, suds boosters, suds depressants, anticaking agents, alkaline compounds, buffers, and the like.

In accordance with one aspect of the invention there may be prepared a mixture of about 50% to about 95% of trisodium carboxymethyloxysuccinate and about 5% to about 15% of a chlorine-releasing or oxygen-releasing agent, the mixture being in dry particulate form, and suitable for use as a builder combination in conjunction with a detergent. Expressed as weight ratios, about 0.05 part to about 1 part by weight of chlorine-releasing agent may be employed in combination with 1 part by weight of trisodium carboxymethyloxysuccinate. A useful ratio is about 0.2 to 1 respectively, by weight.

A detergent of the types disclosed hereinbefore may be admixed with the aforementioned builder mixture in liquid or particulate forms of the products of the invention. Liquid forms may contain

| | Percent or parts by weight | |
|---|---|---|
| | Broad | Preferred |
| Anionic or quaternary ammonium nonsoap surfactant | 10–35 | 15–25 |
| Carboxymethyloxysuccinic acid or salt thereof | 10–50 | 25–35 |
| Chlorine-releasing or oxygen-releasing agent | 2–5 | 2–4 |
| Water | 35–78 | 40–58 |

More specifically, liquid forms may comprise:

i. About 10% to about 35% of an anionic or a quaternary ammonium nonsoap surfactant having detergent properties, or mixtures thereof, ii. about 10% to about 50% of a polycarboxy salt having the general formula

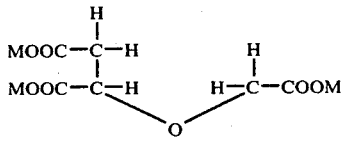

wherein M is hydrogen or an alkali metal cation, iii. about 2% to about 5% of a hypochlorite selected from the group consisting of alkali-metal hypochlorite and hypochlorous acid, iv. about 35% to about 78% water.

Particulate forms may contain

| | Percent or parts by weight | |
|---|---|---|
| | Broad | Preferred |
| Anionic or quaternary ammonium nonsoap surfactant | 10–40 | 15–30 |
| Trisodium carboxymethyloxysuccinate | 25–60 | 30–45 |
| Chlorine-releasing or oxygen-releasing agent | 5–15 | 7–12 |
| Water | 5–15 | 7–10 |

The chlorine-releasing or oxygen-releasing agent will be selected with due regard to their effect on the detergent species contemplated for use therewith, and with due regard to the form of the product. When employed in particulate form, the chlorine-releasing or oxygen-releasing agent may be encapsulated to increase storage stability.

For a better understanding of the invention, reference is made to the following examples, which are illustrative but not limitative of the invention.

EXAMPLE 1

The following example demonstrates the improvement in detergency obtained when sodium hypochlorite is employed in conjunction with trisodium carboxymethyloxysuccinate for fabric washing. To conduct the detergency test, there is placed in the cup of a Terg-O-Tometer 1000 ml of a 180 ppm-hardness water solution of 1.0 gram of trisodium carboxymethyloxysuccinate, 0.89 gram of sodium alkylbenzenesulfonate containing 43% active matter, 0.43 gram of sodium silicate solution (RU type, ratio of $SiO_2$ to $Na_2O$ = 2.4; 46.8% solids) at a temperature of 120° F. Next is added 3.7 ml of a 5.25% solution of sodium hypochlorite, and the pH adjusted to 10.0. Following this there are added four swatches of Dacron/cotton fabric measuring 4½ by 6 inches each, soiled with vacuum cleaner dust. The Terg-O-Tometer is operated for 10 minutes at 90 oscillations of the paddle per minute. The cloths are then rinsed once for one minute in 1 liter of 180 ppm water at 100°–120° F, dried by tumbling at about 110° F, and the detergency measured by determining the reflectance in a Gardner Automatic Color Difference Meter, Model AC-3. The detergency is expressed in DU's, which is a figure obtained by subtracting the reading of the unwashed cloth from the reading of the washed cloth. The quantities of components mentioned above represent 50% by weight of trisodium carboxymethyloxysuccinate, 18% by weight of sodium alkyl (av. 13 carbon atoms) benzenesulfonate, 10% sodium silicate solids, and 10% sodium hypochlorite solids, basis of a complete detergent composition added at 0.2% in the wash solution. The foregoing figures total 88% of a complete detergent composition. The balance, i.e. 12%, is water.

A control test is conducted as above but without the hypochlorite, and a comparable pair of tests is made in which sodium tripolyphosphate is substituted for trisodium carboxymethyloxysuccinate. The results set forth in Table I below, clearly show (1) that sodium hypochlorite improves the detergency of a detergent composition built with trisodium carboxymethyloxysuccinate to exceed the detergency of a corresponding detergent composition built with sodium tripolyphosphate, and (2) that sodium hypochlorite has a greater detergent-enhancing effect on trisodium carboxymethyloxysuccinate than on sodium tripolyphosphate.

Table I

| Component | Percent by Weight | | | |
|---|---|---|---|---|
| | A | B | C | D |
| Sodium alkylbenzenesulfonate | 18 | 18 | 18 | 18 |
| Trisodium carboxymethyloxysuccinate | 50 | 50 | — | — |
| Sodium tripolyphosphate | — | — | 50 | 50 |
| Sodium silicate solids | 10 | 10 | 10 | 10 |
| Sodium hypochlorite* | — | 10 | — | 10 |
| Water | 22 | 12 | 22 | 12 |
| | 100 | 100 | 100 | 100 |
| Detergency, D.U. | 24.0 | 35.0 | 27.0 | 36.2 |

*10% sodium hypochlorite provides 200 ppm NaOCl in the wash solution.

EXAMPLE 2

The following is a liquid detergent composition within the invention.

| | Percent by Weight |
|---|---|
| Sodium salt of a sulfate condensate of an aliphatic monohydric alkanol having about 12–14 carbon atoms and an average of about 3 molar proportions of ethylene oxide | 20.0 |
| Trisodium carboxymethyloxysuccinate | 25.0 |
| Sodium xylenesulfonate | 5.0 |
| Sodium hypochlorite | 4.0 |
| Dimethyl dodecyl amine oxide | 5.0 |
| Sodium silicate solids, ratio of $SiO_2$ to $Na_2O$ = 2.0 | 10.0 |
| NaOH q.s. to pH 11.0 and water q.s. to 100% | 31.0 |
| | 100.0 |

EXAMPLE 3

Following is a particulate detergent within the invention.

| | Percent by Weight |
|---|---|
| Sodium alkylbenzenesulfonate[a] | 20.0 |
| Trisodium carboxymethyloxysuccinate | 48.0 |
| Sodium silicate solids[b] | 6.0 |
| Sodium toluenesulfonate | 2.0 |
| Optical brightener | 0.1 |
| Water | 8.9 |
| Encapsulated potassium dichloroisocyanurate | 15.0 |
| | 100.0 |

[a]the alkyl groups are linear with an average of about 13 carbon atoms and the benzene ring is randomly positioned on the secondary positions along the alkyl chains.
[b]RU-type sodium silicate having an $SiO_2$:$Na_2O$ ratio of 2.4.

To prepare the foregoing composition, all of the components except the potassium dichloroisocyanurate are mixed in a crutcher and spray dried by means well known in the art. Eighty-five parts by weight of the spray-dried composition in particulate form are mixed with 15 parts by weight of encapsulated potassium dichloroisocyanurate of which 33⅓% is encapsulating material, i.e., sodium stearate.

EXAMPLE 4

Following is a quaternary ammonium detergent composition within the invention.

| | Percent by Weight |
|---|---|
| Cetyltrimethylammonium bromide | 20.0 |
| Trisodium carboxymethyloxysuccinate | 50.0 |
| Chlorinated trisodium phosphate | 10.0 |
| Sodium metasilicate | 10.0 |
| Sodium sulfate | 10.0 |
| | 100.0 |

The components, each in particulate form, are conveniently mixed together to form a particulate composition.

EXAMPLE 5

The following mixtures are suitable as builder combinations for use with an anionic or quaternary ammonium detergent.

| | Parts by Weight | | | | | | | | |
|---|---|---|---|---|---|---|---|---|---|
| | A | B | C | D | E | F | G | H | I |
| Trisodium carboxymethyloxysuccinate | 1 | 1 | 1 | 1 | 1 | 1 | 1 | 1 | 1 |
| Sodium hypochlorite | 0.05 | 1 | — | — | — | — | — | — | — |
| Para-toluenesulfondichloramide | — | — | 1 | — | — | — | — | — | — |
| 1,3-dichloro-5,5-dimethylhydantoin | — | — | — | 0.5 | — | — | — | — | — |
| Calcium hypochlorite | — | — | — | — | 0.05 | — | — | — | — |
| N-chloroammeline | — | — | — | — | — | 1 | — | — | — |
| N-chlorosuccinimide | — | — | — | — | — | — | 0.4 | — | — |
| N,N'-dichlorobiuret | — | — | — | — | — | — | — | 0.2 | — |
| Chlorinated dicyandiamide | — | — | — | — | — | — | — | — | 1 |

EXAMPLE 6

A liquid composition in accordance with the invention is prepared in the following manner.

16.65 grams of trisodium carboxymethyloxysuccinate pentahydrate having 72.2% active material are dissolved in 25.19 grams of a liquid commercial household hypochlorite bleach containing 4.74% NaOCl, resulting in the following final composition.

| | Percent by Weight |
|---|---|
| Trisodium carboxymethyloxysuccinate | 28.73 |
| NaOCl | 2.85 |
| Water | 68.42 |
| | 100.00 |

EXAMPLE 7

A liquid composition is prepared in the manner of Example 6 except that the carboxymethyloxysuccinate is the tripotassium salt in anhydrous form. The product has the composition:

| | Percent by Weight |
|---|---|
| Potassium carboxymethyloxysuccinate | 47.51 |
| NaOCl | 2.48 |
| Water | 50.01 |
| | 100.00 |

EXAMPLE 8

The following compositions are prepared at washing concentrations, i.e., aqueous solutions of 0.2% whole built detergent composition.

| | Percent By Weight | | | | | | | |
|---|---|---|---|---|---|---|---|---|
| | A | B | C | D | E | F | G | H |
| Trisodium carboxymethyloxysuccinate | 25 | 25 | 30 | 30 | 60 | 60 | 60 | 60 |
| Sodium tetradecanesulfonate | — | 20 | — | — | — | — | — | 5 |
| Sodium acyl isethionate[a] | — | — | 10 | — | — | — | — | — |
| Sodium dodecyl sulfate | — | — | — | 15 | — | — | 10 | — |
| Potassium alkylbenzenesulfonate[b] | 40 | — | — | — | — | — | 10 | — |
| Disodium alpha-sulfoalkanoate[a] | — | — | — | — | 20 | — | — | 10 |
| N-methyl-N-(2-hydroxy ethyl)-N-(2-hydroxydodecyl)-N-benzyl ammonium chloride | — | — | — | — | — | 15 | — | — |
| Lithium hypochlorite | 10 | — | — | — | — | — | — | 10 |
| Potassium dichloroisocyanurate | — | 5 | — | — | — | 10 | 5 | — |
| N,N-dichlorobenzoyleneurea | — | — | 10 | — | — | — | — | — |
| Para-toluenesulfondichloramide | — | — | — | 15 | — | — | — | — |
| N-chloro-acetylurea | — | — | — | — | 15 | — | — | — |
| Sodium meta silicate | — | 10 | — | — | — | — | — | — |
| Sodium carbonate | 5 | — | 10 | — | — | — | — | — |
| Water | 20 | 40 | 40 | 40 | 5 | 15 | 15 | 15 |
| | 100 | 100 | 100 | 100 | 100 | 100 | 100 | 100 |
| pH at washing concentration | 12 | 10 | 9 | 11 | 9 | 10 | 9 | 12 |

[a]derived from coconut oil fatty acids.
[b]the alkyl groups are linear with an average of about 13 carbon atoms and the benzene ring is randomly positioned on the secondary positions along the alkyl chains.

The foregoing components, except the water, are separately added to one liter of water at 180 ppm hardness as $CaCO_3$ (⅔ $Ca^{++}$, ⅓ $Mg^{++}$) in proportions to provide a washing concentration of 0.2%, whole composition basis. The pH is adjusted, where necessary, to the levels shown.

EXAMPLE 9

A solution containing 0.04 gram of sodium alkylbenzenesulfonate[a], 0.10 gram of sodium carboxymethyloxysuccinate, 0.02 gram sodium hypochlorite, per 100 grams of solution, is employed to wash the mildewed surface of a painted wall. The wall is cleaned, and the mildew discoloration removed by the washing process.

[a] the alkyl groups are linear with an average of about 13 carbon atoms and the benzene ring is randomly positioned on the secondary positions along the alkyl chains.

EXAMPLE 10

The following composition is prepared.

| | Percent By Weight |
|---|---|
| Carboxymethyloxysuccinic acid | 25 |
| Hypochlorous acid | 4 |
| Potassium dodecylbenzenesulfonate | 10 |
| Water | 61 |
| | 100 |
| pH | 3 |

The foregoing composition is advantageously prepared, or acidified to the desired pH level, shortly before use, since the hypochlorous acid component is unstable in aqueous acidic solution.

Having described the invention, persons skilled in the art will be aware of modifications not specifically set forth herein, and the invention is to be limited only within the scope of the appended claims.

What is claimed is:

1. A particulate detergent composition consisting of 20% by weight of cetyltrimethylammonium bromide, 50% by weight of trisodium carboxymethyloxysuccinate, 10% by weight of chlorinated trisodium phosphate, 10% by weight sodium metasilicate and 10% by weight of sodium sulfate.

* * * * *